US005771050A

United States Patent [19]

Gielen

[11] Patent Number: 5,771,050

[45] Date of Patent: Jun. 23, 1998

[54] PRINTER WITH MOVABLE PRINT HEAD

[75] Inventor: Godefridus Gerardus Hubertus Gielen, Beringe, Netherlands

[73] Assignee: Océ-Nederland, B.V., Ma Venlo, Netherlands

[21] Appl. No.: 495,975

[22] Filed: Jun. 28, 1995

[30] Foreign Application Priority Data

Jul. 18, 1994 [EP] European Pat. Off. ..... 94202084

[51] Int. Cl.[6] ..... B41J 29/42

[52] U.S. Cl. ..... 347/19; 347/37

[58] Field of Search ..... 347/19, 37, 41; 346/117

[56] References Cited

U.S. PATENT DOCUMENTS

| | | | |
|---|---|---|---|
| 4,675,696 | 6/1987 | Suzuki | 346/46 |
| 4,688,050 | 8/1987 | Tsao | 346/76 |
| 4,916,638 | 4/1990 | Haselby et al. | 395/105 |
| 4,965,593 | 10/1990 | Hickman | 347/12 |
| 5,469,198 | 11/1995 | Kadonaga | 347/41 |

FOREIGN PATENT DOCUMENTS

| | | |
|---|---|---|
| 60-127173 | 7/1985 | Japan . |
| 56-90383 | 7/1987 | Japan . |
| 3-162967 | 7/1991 | Japan . |
| 5-238004 | 9/1993 | Japan . |

*Primary Examiner*—N. Le
*Assistant Examiner*—Craig A. Hallacher

[57] ABSTRACT

A printer having a movable print head including a print head mounted on a carriage and having an array of printing elements for printing lines of pixels onto a recording medium during a scanning motion, mechanical means for moving the carriage and recording medium relative to one another in a main scanning direction (A) and a subscanning direction (B) perpendicular to the main scanning direction, and an additional actuator for dynamically displacing the print head, relative to the carriage, in a scanning direction, in order to fine tune the position of the print head relative to the recording medium.

17 Claims, 4 Drawing Sheets

PRINTER WITH MOVABLE PRINT HEAD

BACKGROUND OF THE INVENTION

1. Field of the Invention

The present invention relates to a printer, and more specifically to a printer having a movable print head.

2. Discussion of Related Art

A printer similar to that herein under consideration has been disclosed in U.S. Pat. No. 4,688,050. This known printer comprises a platen for advancing a recording medium, e.g. a sheet of paper, in a subscanning direction, and a carriage which is movable in a main scanning direction perpendicular to the subscanning direction. On the carriage, there is mounted a print head which comprises a linear array of printing elements, e.g. heating elements in the case of a thermal printer or nozzles in the case of an ink jet printer, which are arranged in the subscanning direction, so that a plurality of pixel-wide image lines can be printed during each scanning movement of the carriage.

If the advance of paper in the subscanning direction is not controlled with a high degree of accuracy, white or dark streaks may be produced on the printed image, because either a gap or a slight overlap may occur between adjacent lines. In order to alleviate this problem, the print head of this known printer is equipped with a sensor for detecting a registration mark which has been printed on the margin of the paper during a previous scan by means of a special printing element provided on the print head. Further, the number of printing elements in the array is larger than the number of print lines produced per main scan.

When the sensor detects that the registration mark on the paper is properly adjusted in relation to the print head, at least one print element at each end of the array is kept inoperative, and only the central group of printing elements is used for actually printing the image information. If, however, the sensor detects that the paper has been advanced too much or too little, then the printing information is diverted to another group of printing elements which is offset from the original group by one or more pixels in an appropriate direction so as to compensate for the registration error. Thus, the effective positions of the printing elements are virtually shifted in the subscanning direction whereas the print head itself remains stationary relative to the printing paper in the subscanning direction. This known printer has the drawback that the effective positions of the printing elements can only be shifted in increments of the distance between two printing elements, so that the registration accuracy is limited to plus or minus half the distance between two printing elements. As a result, the quality of the printed image may be poor.

Many other printers which are disclosed, for example in JP-A-55-113572 and JP-A-63-285068, use registration marks and sensors for directly controlling the advance of the recording medium. However, if it is intended to increase the resolution of the printer to for example 400 dpi or even 600 dpi, it becomes increasingly difficult to control the advance of the recording medium with sufficient accuracy, and expensive equipment is required for this purpose.

SUMMARY OF THE INVENTION

Therefore, it is an object of the present invention to provide a printer which will overcome the above noted disadvantages.

A further object of the present invention is to provide a printer having a movable print head.

It is a further object of the present invention to provide a printer which is structurally simple and can nevertheless achieve a high degree of accuracy in registration between the printing elements and the lines already printed on a recording medium.

Another object of the invention is to provide a printer which comprises an array of a plurality of printing elements on a common print head and which is provided with a simple structure for interlaced printing so as to achieve a printing resolution which is higher than the pitch of the printing elements in the array.

The foregoing objects and others are accomplished in accordance with the present invention, generally speaking, by providing a printer equipped with means for dynamically, i.e. during the printing operation, displacing the print head, relative to the carriage, in a scanning direction. The printer according to the present invention comprises a print head mounted on a carriage and has at least one printing element for successively printing pixels onto a recording medium and means for moving the carriage and recording medium relative to one another in a main scanning direction and a subscanning direction perpendicular to the main scanning direction. According to the invention, an actuator, preferably electromechanical, is used for displacing the print head relative to the carriage, so as to finely adjust the print head position. In comparison to the print head disclosed in U.S. Pat. No. 4,688,050 referenced above, the instant invention has the advantage that the registration accuracy can be enhanced far beyond the distance between two printing elements, so that the quality of the printed image is significantly improved.

In comparison to conventional printers in which the registration control is exclusively performed by controlling the advance of the recording medium, the instant invention has the advantage that the mass of inertia of the print head which has to be moved during fine adjustment is much smaller than the mass of inertia of the mechanical members, e.g. a platen, which are used for advancing the recording medium. As a consequence, the electromechanical actuator used according to the invention can be comparatively small and inexpensive and, in addition, the time required for registration control can be reduced so that the overall printing speed is enhanced.

According to a further embodiment of the invention, the displacement of the print head relative to the carriage is controlled in response to the signal of a sensor which is arranged on the print head for detecting a registration mark on the printing paper.

In printers of the type discussed above, in which the carriage is moved back and forth in the main scanning direction over the whole width of the recording medium, the direction of displacement of the print head relative to the carriage is perpendicular to the direction of movement of the carriage itself, so that the mounting of the print head permitting the displacement in the subscanning direction will not be affected by the forces of inertia resulting from the back and forth movement of the carriage. Thus, the print head can be mounted stably without incurring the risk of undesired vibrations.

However, the invention is not limited to printers of this type. For example, the printer could also be of a type in which the recording medium is fixed onto a rotating drum for producing the relative movement between the recording medium and the print head in the main scanning direction, and the carriage carrying the print head is advanced in small increments in the subscanning direction. In this instance, the carriage is used for coarsely adjusting the position of the print head in the subscanning direction, and the electromechanical actuator is used for fine-adjustment in the same direction. In this case, the forces of inertia caused by the acceleration and deceleration of the carriage will be less important because the speed of advance of the carriage in the subscanning direction can be made comparatively small without significantly increasing the overall printing speed. In addition, the electromechanical actuator can be used for actively damping vibrations which may be caused by the deceleration of the carriage.

In an alternative embodiment for providing a printer which comprises an array of a plurality of printing elements on a common print head and which is provided with a simple structure for interlaced printing so as to achieve a printing resolution which is higher than the pitch of the printing elements in the array, the actuator discussed above is used for displacing the print head in the subscanning direction by an increment which amounts to the pitch of the printing elements divided by an integral number n, so that n-fold interlacing is achieved by repeating n scans in the main scanning direction with successively increased displacement of the print head, without changing the relative position of the carriage and the recording medium in the subscanning direction. Therefore, if the pitch of the printing elements is p and there are m printing elements active in the print head, then the actuator means displaces the print head over a distance of p/n for each of the n interlaced scans. In this way, m×n lines are printed in total. After the n-th scan has been made, the spaces between the m lines printed during the first of the n scans have been filled, and the printing medium is moved over a distance of m×p, being the width of the strip of m×n lines, so that a new strip of m×n interlaced print lines can be printed. At the same time, the actuator means moves the print head relative to the carriage back to its initial position. Before starting printing a new strip, the fine position adjusting procedure using the sensor is performed.

With this printer, it is possible to achieve a high resolution of for example 400 dpi, even if the dimensions of the printing elements and the mounting structures thereof make it difficult to reduce the spacings between adjacent printing elements to the size of one pixel. The invention takes advantage of the fact that the actuator permits adjustment to the position of the print head quickly and accurately, so that interlacing can be performed with a high degree of accuracy and with high speed, because it is not necessary to advance the recording medium after each main scan. In the interlacing mode, a sensor for detecting registration marks on the recording medium may be used for registering the paper feed motion after the completion of n interlaced scans.

As an actuator, any suitable known electromechanical devices can be used, including electromagnetic devices, magnetostrictive devices, pneumatic or hydraulic devices combined with electric pressure control means, e.g. hybrid control systems including fluidic elements, and the like. Preferably, however, piezoelectric actuators are used, because they provide a quick response and permit to stably support the print head and also have a substantially linear voltage/displacement characteristic which facilitates the electronic control. Among the piezoelectric actuators, ceramic multilayer actuators (CMAs) are particularly preferred, because they offer a large range of displacements and require only a relatively low control voltage.

For displaceably mounting the print head on the carriage, it is preferable to use a parallelogram linkage with link bars having flexible hinge portions at their opposite ends. The piezoelectric actuator may be arranged to act upon one or both of the longitudinal ends of the print head or may be arranged to act upon the link bars of the parallelogram so that a greater displacement can be achieved by lever action of the link bars. Alternatively, it is also possible to use bending-type piezoelectric actuators as the link bars.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DISCUSSION OF THE INVENTION

Figure 1:
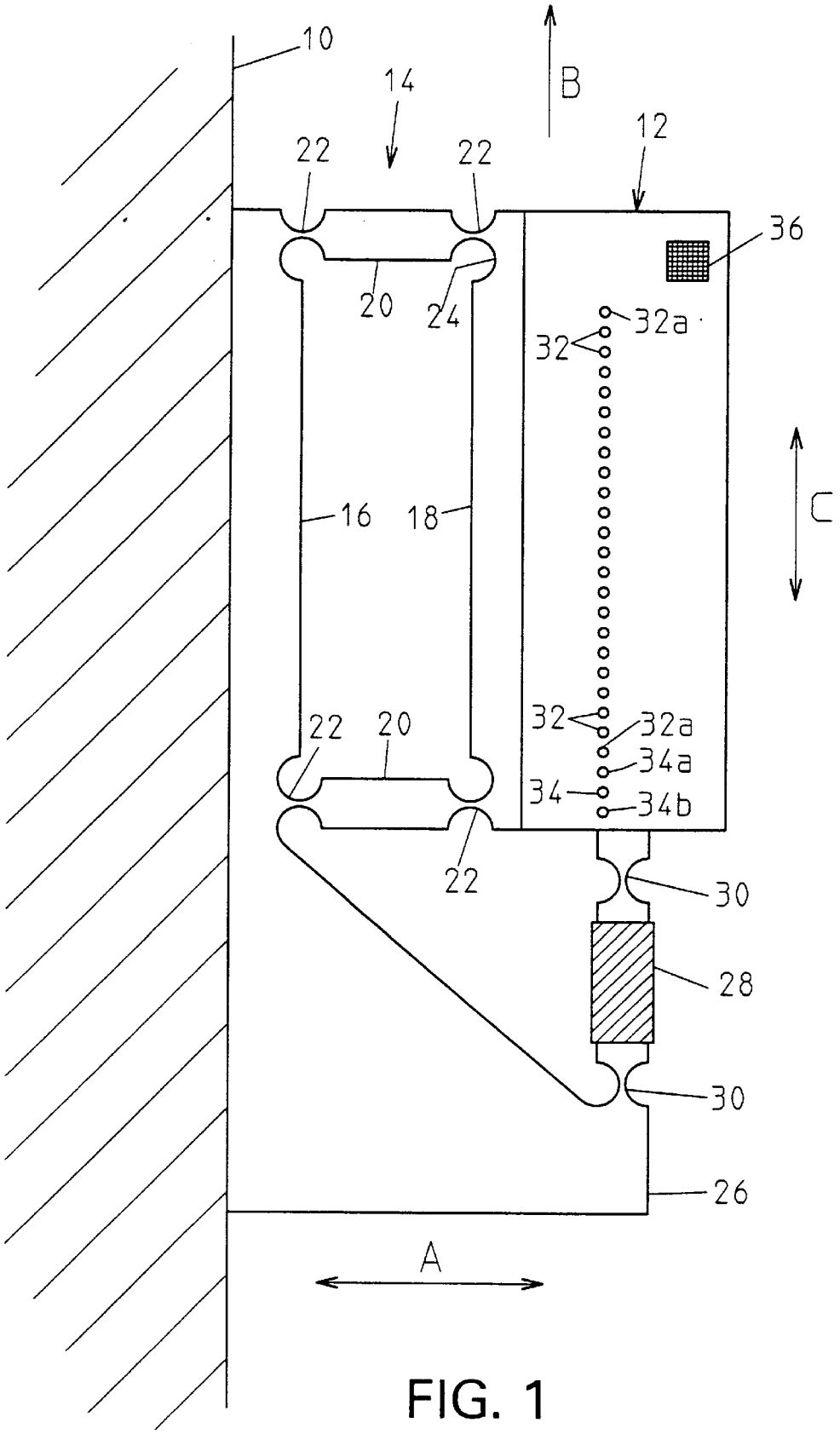
FIG. 1 is a schematic view of a print head assembly of a printer according to the present invention.

Referring to FIG. 1, an ink jet printer comprises a carriage 10 which is movable back and forth in a main scanning direction indicated by arrows A. A recording medium (not shown in FIG. 1) which may, for example, be a sheet of paper, is fed in a subscanning direction which is indicated by arrow B and is perpendicular to the main scanning direction A. A print head 12 is mounted to the carriage 10 by means of a parallelogram linkage 14, so that it is rigidly supported on the carriage in the main scanning direction A but is displaceable in opposite directions parallel with the subscanning direction B, as is indicated by arrows C.

The parallelogram linkage 14 is formed of a one-piece metal member and comprises a base portion 16 fixed to the carriage 10, a bracket portion 18 to which the print head 12 is secured, and two link bars 20 connected to the base portion 16 and the bracket portion 18, respectively, through hinge portions 22. Each hinge portion is formed by a relatively thin and hence flexible web which is bounded by approximately circular or semi-circular recesses formed in the metal member. The parallelogram linkage 14 is formed integrally with a support 26 for a ceramic multilayer actuator (CMA) 28 arranged for controlling the displacement of the print head 12 in the directions C. As is generally known in the art, a CMA is formed by a plurality of layers of piezoelectric ceramics alternatingly laminated with electrodes. By applying a voltage to the electrodes, the CMA 28 is caused to expand or shrink in the directions C, depending on the polarity of the voltage applied. The CMA 28 is connected to the support 26 and to the print head 12 through hinge portions 30 which have the same configuration as the hinge portions 22 discussed above.

The print head 12 is provided with a number of nozzles 32, 32*a*, 32*b*, 34, 34*a* and 34*b* which are arranged with equal spacings in a linear array or column extending in the subscanning direction B. The nozzles 32, 32*a* and 32*b* serve as printing elements for printing individual pixels on the sheet of paper by ejecting ink droplets onto the paper in accordance with the image information supplied to the print head. The nozzles 34, 34*a* and 34*b* serve as marker nozzles for printing a registration mark onto the margin portion of the paper.

The print head 12 is further provided with an electro-optical sensor 36 which is positioned near the end of the row of nozzles opposite to the marker nozzles. When a registration mark has been printed onto the paper by means of one of the marker nozzles, e.g. the nozzle 34 and then, after the carriage 10 has performed one back and forth stroke in the main scanning direction A, the paper is advanced in the subscanning direction B by an amount corresponding to the length of the row of printing nozzles, the registration mark can be detected by the sensor 36.

Figure 3:
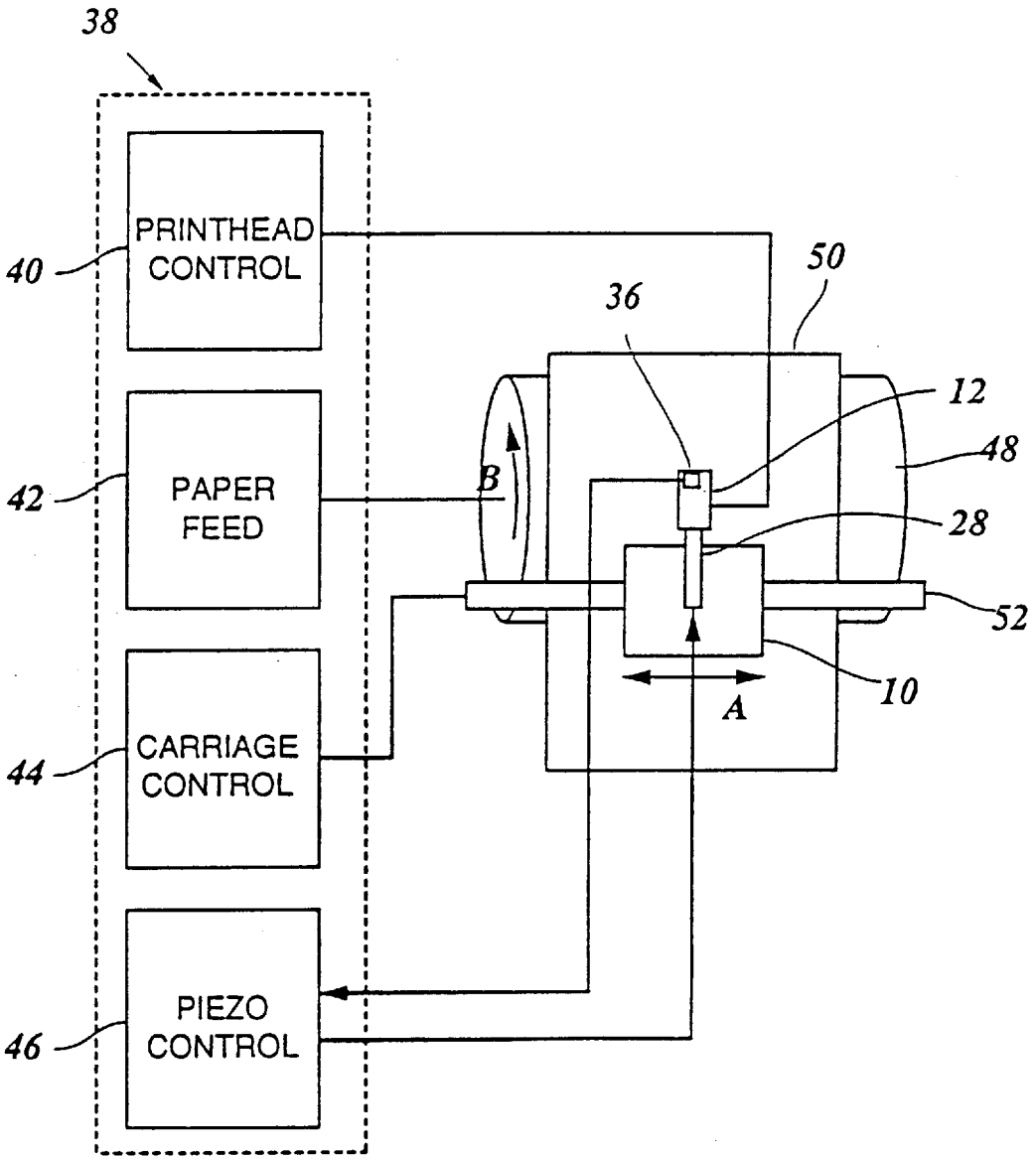
FIG. 3 is a block diagram of the printer.

As is shown in FIG. 3, a control unit 38 for the printer comprises a print head control block 40, a paper feed control block 42, a carriage control block 44 and a piezo control block 46. The control unit may be formed by a microcomputer programmed to perform all the functions symbolized by the four control blocks 40 to 46. The paper feed control block 42 controls the function of the paper feed system which may for example comprise a platen 48 for advancing a sheet of paper 50 (recording medium) in the subscanning direction B. The carriage control block 44 controls the function of a carriage drive system 52 for moving the carriage 10 in the main scanning direction A. The piezo control block 46 receives a signal from the sensor 36 and controls the actuator 28 in accordance therewith. The print head control block 40 cooperates with the piezo control block 46 and selects the printing nozzles 32, 32*a*, 32*b* and actuates the marker nozzles 34, 34*a*, 34*b* in accordance with the signal from the sensor 36, as will be explained below, and supplies control signals to the print head 12 in accordance with the image information to be printed.

The registration mark has the form of a dot or a faint line segment extending in the main scanning direction A. The sensor 36 is preferably formed by a matrix array of light sensitive elements (e.g. an area CCD) and is capable of detecting the position of the registration mark with a resolution which is significantly higher than the printing resolution of the printer. In case a registration mark in line form is used, a one-dimensional sensor may be used.

If the paper has been advanced in the direction B exactly by the correct amount, the sensor 36 will detect the registration mark at a predetermined target position, thus assuring that the new lines to be printed with the printing nozzles will correctly adjoin the lines that have been printed during the previous stroke of the carriage 10. If, however, the paper has not been advanced by the correct amount, due to paper slippage or inaccuracies in the paper feed system of the printer, then the sensor 36 will detect a deviation of the registration mark from the target position, and in reaction the piezo control 46 will supply an appropriate voltage to the CMA 28 in order to precisely adjust the print head 12 to the registration mark before the next stroke of the carriage 10 is started. At the beginning of the next stroke, a new registration mark is printed in the margin portion before the printing nozzles reach the printable area of the paper. Accordingly, the new registration mark represents the adjusted position of the print head.

Figure 2:
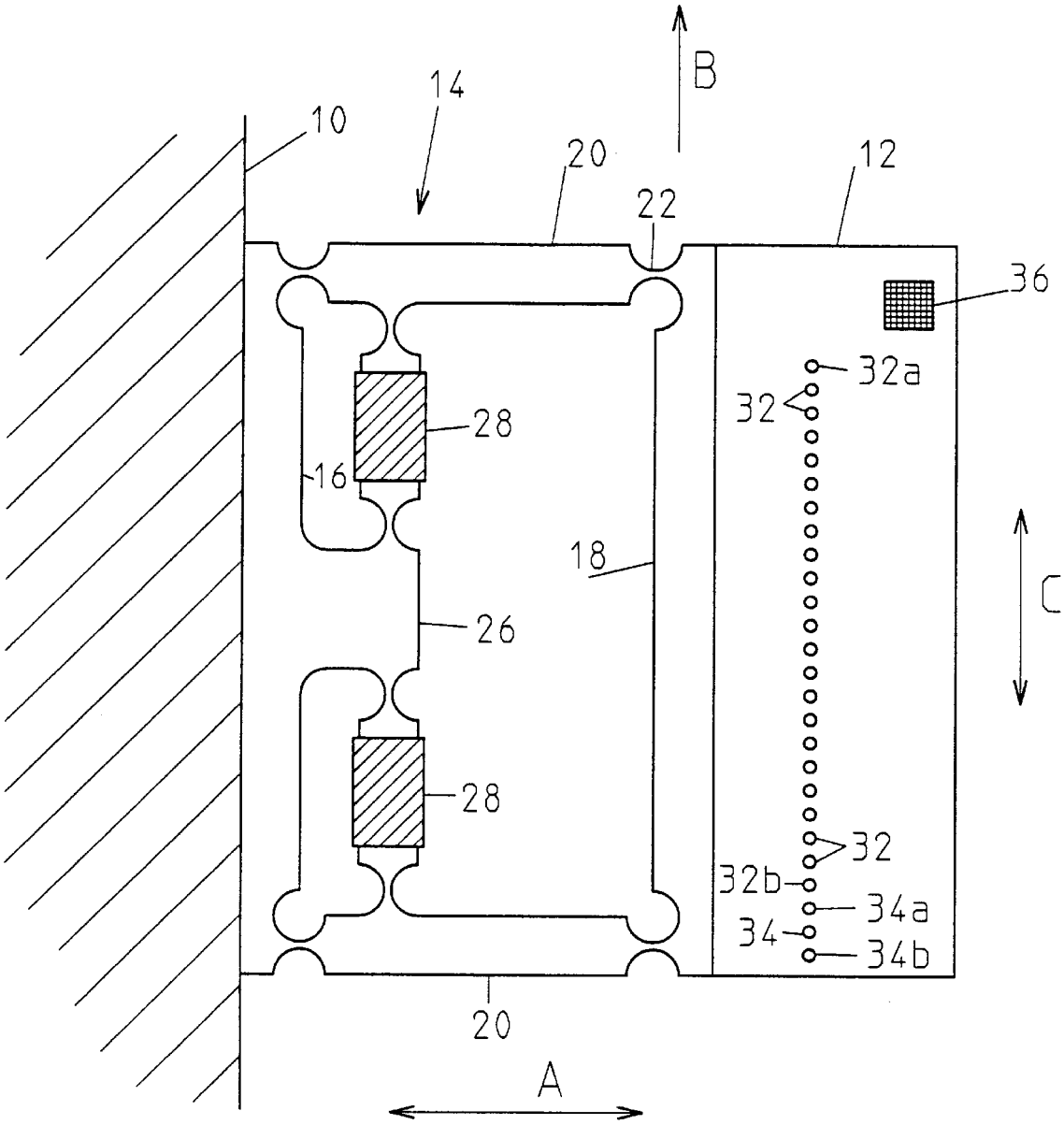
FIG. 2 shows a modification of the print head assembly.

The modified embodiment shown in FIG. 2 differs from the arrangement according to FIG. 1 in that the mount 26 is provided inside of the parallelogram linkage 14 and two piezoelectric actuators (CMAs) 28 are connected between the mount 26 and each of the link bars 20 in the vicinity of the base portion 16. In this embodiment, the displacement of the CMAs is magnified due to the lever action of the link bars 20 so that the position of the print head 12 can be adjusted within a broader range.

In the embodiments described herein, the printing nozzles comprise twenty regular printing nozzles 32 and two auxiliary printing nozzles 32*a*, 32*b* provided at both ends of the column of regular printing nozzles. During normal operation, i.e. when the paper is advanced correctly, only the regular printing nozzles 32 are used, so that twenty image lines are printed during one stroke of the carriage 10. If, however, the paper has been advanced too far and the deviation of the registration mark from the target position amounts to more than half the spacing between two adjacent nozzles, then the auxiliary nozzle 32*a* is used for printing, and one of the regular printing nozzles 32 at the opposite end of the row (adjacent the auxiliary printing nozzle 32*b)* is kept inoperative. In this case, the registration mark is not printed with the nozzle 34 but with the nozzle 34*a* so that the correct positional relationship between the registration mark and the printed image lines is maintained. Similarly, if the paper has been advanced too little, the auxiliary printing nozzle 32*b* and the nineteen regular printing nozzles 32 adjacent thereto are used for printing the image, and the marker nozzle 34*b* is used for printing the registration mark.

In this way, a coarse correction of registration errors is achieved by properly selecting the printing nozzles, and the actuator 28 is needed only for an additional fine correction. This has the advantage that the range in which the print head 12 can be displaced by the actuator or actuators 28 needs not be larger than ±½ of the spacing between adjacent nozzles. Of course, it is possible to provide more than one auxiliary nozzle at each end of the row of regular printing nozzles, so that even larger deviations can be corrected. It is also possible to use only a single marker nozzle and to store a different target position for the registration mark when one of the auxiliary nozzles has been used for printing. However, the use of a plurality of marker nozzles has the advantage that the sensor 36 needs to have only a comparatively small sensitive range and can nevertheless safely detect the registration mark.

The marker nozzles may be structurally identical with the printing nozzles. If it is desired to avoid the visible registration marks on the margin of the printed image, it is possible to supply the marker nozzles with a specific ink which is practically imperceptible by the human eye but can be detected by the sensor 36. On the other hand, when the marker nozzles are supplied with the same ink as the printing nozzles, it is determined merely by the control system whether a specific nozzle has the function of a printing nozzle or a marker nozzle, so that the flexibility of the system is increased.

In general, the number of image lines printed in one stroke of the carriage may also be varied. If, for example, the paper feed system includes a systematic error so that the registration errors produced in each scan cycle accumulate and the adjustment range provided by the auxiliary nozzles and actuators 28 tend to become exhausted, the paper feed error can be compensated by performing one or more scan cycles with a reduced or increased number of image lines and with appropriate selection of the marker nozzle. In this way, the printer as a whole becomes very robust against paper feed errors, so that a simple and inexpensive paper feed system may be used.

In the shown embodiments, in which the array of printing nozzles and marker nozzles consists only of a single column, the spacing between adjacent image lines cannot be reduced below a certain limit which depends on the outer dimensions of the individual nozzles (e.g. about 0.5 mm). It is however possible to achieve a higher resolution by using an array in which the nozzles are staggered in a plurality of columns. If, for example, an array with four columns is used, it should be possible to achieve a one-stroke resolution of 8 lines/$\mu$m, so that the spacing between the lines will be as small as 125 $\mu$m. If the resolution is to be increased further to 400 dpi, the image lines must be only 63.5 mm apart. This can be achieved by interlacing the lines printed in subsequent strokes. The printer according to the invention is particularly useful for such an interlaced printing mode, as will be explained below.

Figure 4:
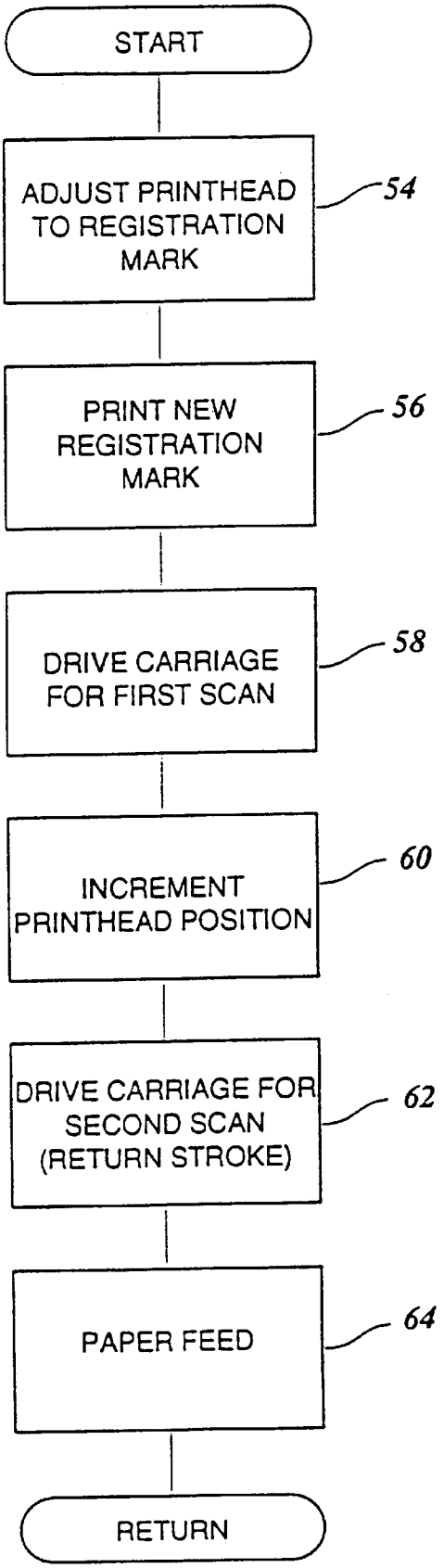
FIG. 4 is a flow chart illustrating an interlacing printing mode.

FIG. 4 is a flow chart showing the control operations performed by the control unit 38 (FIG. 3) in the interlacing mode during one complete scan cycle of the carriage 10. In step 54, the print head 12 is adjusted in accordance with the registration mark as has been described above. In step 56, the carriage 10 starts to move, and one of the marker nozzles is actuated for printing the new registration mark. In step 58, the carriage 10 performs a stroke from left to right in FIGS. 1, 2 and 3 to print a number of image lines with the selected printing nozzles. It is assumed here that the pitch of the printing nozzles and hence the distance of the lines printed during this stroke is twice as large as the size of one pixel of the printed image, so that the image lines are separated by gaps with a width of one pixel.

When the carriage has completed its stroke, in step 60, the actuator 28 is controlled to shift the position of the print head 12 by a predetermined increment in the subscanning direction B. This increment corresponds to one pixel, i.e. one half of the pitch of the nozzles. Since the piezoelectric actuator 28 has a linear response characteristic, this increment can be achieved by increasing the voltage applied to the actuator by a fixed amount. Thus, the sensor 36 is not needed for controlling this movement of the print head.

In step 62, the carriage 10 performs its return stroke to the initial position, and the print head is supplied with the image information for the lines which are interlaced with the lines printed during the forward stroke. At the end of the return stroke, in step 64, the paper is advanced by the width of the image strip which has been printed in this cycle, and then the program returns to START to begin with a new scan cycle.

For example, the relative movement between the recording medium and the carriage may be achieved in any suitable manner, e.g. by moving the recording medium on a conveyor belt or the like or by holding the recording medium stationary and moving the carriage in two dimensions.

The invention is not limited to ink jet printers but may also be applied to other scanning-type printers such as thermal printers, matrix printers and the like. Further, the invention is of course applicable also to color printers. The printing elements for the different colors may then be provided on a common print head or on separate print heads which can be adjusted individually. In the latter case, it is also possible to use the actuators associated with the different print heads for controlling the color registration electronically.

Instead of using a sensor which quantitatively detects the position of the registration mark with high resolution, it is possible to use a sensor which can only detect whether or not the registration mark is present at the target position or at one of a plurality of target positions spaced apart by the pitch of the printing elements. Adjustment of the print head by means of the actuator is then performed in a feedback loop. If the actuator is used only for interlacing, the sensor and the marker nozzles may be omitted completely.

While, in the embodiment of FIG. 4, two groups of image lines are interlaced and the paper is advanced each time the carriage has performed two strokes (forward stroke and return stroke), it is also possible to advance the paper only after three or more strokes of the carriage, so that three or more groups of image lines are interlaced. If an odd number of groups of print lines are interlaced, registration marks may be provided on both margins of the printed image, so that the adjustment of the print head can be performed in both extreme positions of the carriage. The sensor signal relating to the print head position relative to the registration mark may additionally be used for synchronizing the main scan, so that successive scan lines can easily be aligned horizontally as well.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A printer comprising:

a carriage;

a print head mounted on said carriage having at least one printing element for successively printing pixels onto a recording medium;

means for moving said carriage and said recording medium relative to one another in a main scanning direction (A) and a subscanning direction (B) perpendicular to said main scanning direction; and actuator means for dynamically displacing said print head, relative to said carriage, in the subscanning direction, a sensor provided on said print head for detecting a registration mark on said recording medium and for providing a sensor signal indicative of a position of said print head relative to said registration mark, said printer also including a control means connected to said sensor for controlling, in response to said sensor signal, said means for dynamically displacing said print head relative to said carriage, thereby adjusting the position of said print head relative to said registration mark.

2. A printer according to claim 1, wherein said print head comprises a plurality of printing elements for printing image information, said printing elements being arrayed in said subscanning direction (B), for printing a plurality of lines during one stroke of said carriage in said main scanning direction (A), the plurality of printing elements being greater than the plurality of image lines printed during one stroke of said carriage in said main scanning direction (A), said printer further including a print head control means for selecting a group of adjacent printing elements in response to said sensor signal, said selected printing elements having a position that is coarsely adjusted to the registration mark.

3. A printer according to claim 2, wherein said print head further includes at least one marker printing element for printing the registration mark on said recording medium.

4. A printer according to claim 3, wherein said print head includes a plurality of marker printing elements and that marker printing element actually used for printing said registration mark is selected from said plurality of printing elements selected for printing image information.

5. A printer according to claim 2, wherein said print head includes a plurality of marker printing elements and that marker printing element actually used for printing said registration mark is selected from said plurality of printing elements selected for printing image information.

6. A printer according to claim 2, wherein said plurality of printing elements comprise ink jet nozzles.

7. A printer according to claim 1, wherein said print head further includes at least one marker printing element for printing the registration mark on said recording medium.

8. A printer according to claim 6, wherein said print head includes a plurality of marker printing elements and that marker printing element actually used for printing said registration mark is selected from said plurality of printing elements selected for printing image information.

9. A printer according to claim 1, wherein said at least one printing element is an ink jet nozzle.

10. A printer according to claim 1, wherein said print head comprises a plurality of printing elements in the form of ink jet nozzles.

11. A printer comprising:

a carriage;

a print head mounted on said carriage having a number $m \geqq 2$ of printing elements arrayed in said subscanning direction with a predetermined pitch p for successively printing pixels onto a recording medium;

means for moving said carriage and said recording medium relative to one another in a main scanning direction (A) and a subscanning direction (B) perpendicular to said main scanning direction;

actuator means for dynamically displacing said print head, relative to said carriage, in the subscanning direction; and control means for controlling said carriage, said actuator means for displacing said print head relative to said carriage and said print head, such that said carriage performs a number $n \geqq 2$ of scans in said main scanning direction with a displacement of said print head, relative to said carriage, in said subscanning direction, being increased in increments of p/n per scan, so that n times m lines are printed in an interlaced manner before the relative position of said carriage with respect to said recording medium in said subscanning direction is changed.

12. A printer according to claim 11, further including a sensor arranged on said print head for detecting a registration mark on said recording medium and for providing a sensor signal indicative of the position of said print head relative to said registration mark wherein, each time n scans have been performed, said control means activates said actuator means for moving said print head and said carriage relative to one another back to their initial relative positions and said means for moving said carriage and said printing medium over a distance m×p, and controls, in response to said sensor signal, said means for displacing said print head relative to said carriage, thereby adjusting the position of said print head relative to said registration mark.

13. A printer according to claim 11, wherein said actuator means for displacing said print head relative to said carriage is an electromechanical actuator.

14. A printer according to claim 13, wherein said electromechanical actuator is a piezoelectric actuator.

15. A printer according to claim 14, wherein said piezoelectric actuator is a ceramic multilayer actuator.

16. A printer according to claim 11, wherein said print head comprises a plurality of printing elements in the form of ink jet nozzles.

17. A printer comprising:

a carriage;

a print head mounted on said carriage having at least one printing element for successively printing pixels onto a recording medium;

means for moving said carriage and said recording medium relative to one another in a main scanning direction (A) and a subscanning direction (B) perpendicular to said main scanning direction;

actuator means for dynamically displacing said print head, relative to said carriage, in the subscanning direction wherein said print head is mounted to said carriage through a parallelogram linkage having a one-piece construction including a base fixed to said carriage, a bracket portion fixed to said print head and link bars connected to said base portion and said bracket portion through flexible hinge portions, and said actuator means intervenes between a support formed integrally with said base portion and an intermediate portion of at least one of said link bars.

* * * * *